US005418325A

United States Patent [19]

Aoki et al.

[11] Patent Number: 5,418,325

[45] Date of Patent: May 23, 1995

[54] AUTOMATIC MUSICAL ARRANGEMENT APPARATUS GENERATING HARMONIC TONES

[75] Inventors: Eiichiro Aoki, Hamamatsu; Kazunori Maruyama, Tama, both of Japan

[73] Assignee: Yamaha Corporation, Japan

[21] Appl. No.: 38,910

[22] Filed: Mar. 29, 1993

[30] Foreign Application Priority Data

Mar. 30, 1992 [JP] Japan ..... 4-103493

[51] Int. Cl.[6] ..... G10H 1/38

[52] U.S. Cl. ..... 84/613; 84/650; 84/DIG. 22

[58] Field of Search ..... 84/609-614, 84/634-638, 649-652, 666-669, DIG. 22

[56] References Cited

U.S. PATENT DOCUMENTS

| | | | |
|---|---|---|---|
| 4,508,002 | 4/1985 | Hall et al. . | |
| 4,926,737 | 5/1990 | Minamitaka . | |
| 4,951,544 | 8/1990 | Minamitaka | 84/613 |
| 4,982,643 | 1/1991 | Minamitaka | 84/613 |
| 5,003,860 | 4/1991 | Minamitaka | 84/613 X |
| 5,088,380 | 2/1992 | Minamitaka | 84/637 |

FOREIGN PATENT DOCUMENTS 63-42274 8/1988 Japan .

*Primary Examiner*—Stanley J. Witkowski
*Attorney, Agent, or Firm*—Graham & James

[57] ABSTRACT

Melody note data and chord data are inputted to an automatic arrangement apparatus. When it is detected that a melody note is a nonharmonic note, the melody note is converted into a harmonic note, and an additional note (e.g., a countermelody note) is generated based on the converted harmonic note. An electronic musical instrument comprises such an automatic arrangement apparatus. Melody note data and chord data are inputted to the instrument according to a performance of a player. When it is detected that a melody note is a nonharmonic note, the melody note is converted into a harmonic note, an additional note is determined based on the converted harmonic note, and the additional note is produced as a tone in real time simultaneously with a performance tone.

20 Claims, 12 Drawing Sheets

FIG. 10

| CHORD TYPE / DEGREE COUNT | M (7) | m7 | Dom7 | m7b5 | Sus47 | mM7 | Aug7 | Dim7 |
|---|---|---|---|---|---|---|---|---|
| # 1 | 1 | 1 | 1 | 1 | 1 | 1 | 1 | 1 |
| 2 | 1 | 1 | 1 | 1 | 1 | 1 | 1 | 1 |
| # 2 | 3 | # 2 | 3 | # 2 | 3 | # 2 | 3 | # 2 |
| 4 | 3 | # 2 | 3 | # 2 | 4 | # 2 | 3 | # 2 |
| ⋮ | ⋮ | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ | ⋮ |

FIG. 11

| CHORD TYPE / DEGREE PROGRESSION | M (7) | m7 | Dom7 | m7b5 | Sus47 | mM7 | Aug7 | Dim7 |
|---|---|---|---|---|---|---|---|---|
| (# 1) 2↔1 | 1↔1 | 1↔1 | 1↔1 | 1↔1 | 1↔1 | 1↔1 | 1↔1 | 1↔1 |
| 2↔3 | 3↔3 | # 2↔# 2 | 3↔3 | # 2↔# 2 | 1↔1 | # 2↔# 2 | 3↔3 | # 2↔# 2 |
| 2↔# 2 | 1↔3 | 1↔# 2 | 1↔3 | 1↔# 2 | 1↔1 | 1↔# 2 | 1↔3 | 1↔# 2 |
| 2↔# 1 | 3↔1 | 1↔# 2 | 3↔1 | # 2↔1 | 1↔1 | # 2↔1 | 3↔1 | 1↔# 2 |
| # 2↔3 | 3↔3 | # 2↔# 2 | 3↔3 | # 2↔# 2 | 4↔4 | # 2↔# 2 | 3↔3 | # 2↔# 2 |
| 4↔3 | 3↔3 | # 2↔# 2 | 3↔3 | # 2↔# 2 | 4↔4 | # 2↔# 2 | 3↔3 | # 2↔# 2 |
| 4↔5 | 5↔5 | 5↔5 | 3↔5 | 5↔5 | 4↔5 | 5↔5 | 3↔5 | 5↔5 |
| 4↔# 4 | 3↔5 | # 2↔# 5 | 3↔5 | # 4↔# 4 | 4↔4 | # 2↔5 | 3↔5 | # 4↔# 4 |
| ⋮ | ⋮ | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ | ⋮ |

AUTOMATIC MUSICAL ARRANGEMENT APPARATUS GENERATING HARMONIC TONES

BACKGROUND OF THE INVENTION

1. Field of the Invention

The present invention relates to an automatic arrangement apparatus and an electronic musical instrument for performing an automatic operation while arranging notes in real time and, more particularly, to a technique for automatically generating additional notes such as contrapuntal notes, countermelody notes and the like on the basis of melody notes.

1. Description of the Related Art

Conventionally, an electronic musical instrument For automatically generating additional notes such as countermelody notes on the basis of melody notes is known. For example, Japanese Patent Publication (Koukoku) No. 63-42274 discloses an electronic musical instrument, which selects and determines new countermelody notes from chord constituting notes for an accompaniment. The electronic musical instrument selects and determines new countermelody notes from chord constituting notes having a predetermined interval relationship with melody notes. Thus, countermelody tones harmonized with melody tones and having a full of musical expressions can be automatically produced.

A music piece has a chord progression based on a melody. In general, melody notes have a complicated sequence, and are normally selected from harmonic notes of corresponding chords but may sometimes be selected from nonharmonic notes. On the other hand, additional notes such as countermelody notes should be selected from harmonic notes of corresponding chords unless they are intentionally selected according to the music theory.

Therefore, in the prior art, since chord constituting notes having the predetermined interval relationship with melody notes are selected and determined as countermelody notes regardless of harmonic notes or nonharmonic notes, a countermelody note selected and determined based on a melody note as a nonharmonic note becomes an unexpected note against the music theory, and destroys a, chord, thus giving a musically unstable sense.

Further, U.S. Pat. No. 4,926,737 issued on May 22, 1990 discloses an automatic composer which extracts a nonharmonic tone from a melody. U.S. Pat. No. 4,508,002 issued on Apr. 2, 1985 discloses a method and apparatus which automatically generate an accompaniment tone according to a designated chord and a designated melody note.

SUMMARY OF THE INVENTION

An object of the present invention is to provide an automatic arrangement apparatus and an electronic musical instrument, which can automatically generate additional notes harmonized with melody notes without destroying chords and giving a musically unstable sense.

According to the present invention, an automatic arrangement apparatus for performing an automatic arrangement on the basis of melody notes and chords, comprises conversion means for converting nonharmonic notes, with respect to the chords, of the melody notes into harmonic notes, and means for generating additional notes on the basis of the converted melody notes.

Also, an electronic musical instrument for performing an automatic accompaniment on the basis of a designated chord, comprises a performance operation member for generating first performance data including tone pitch data according to a performance operation of a player, conversion means for, when tone pitch data in the first performance data becomes a nonharmonic tone pitch with respect to the chord, converting the first performance data into second performance data so that the tone pitch data becomes a harmonic tone pitch, and means for generating third performance data as additional tone data on the basis of the second performance data. The electronic musical instrument generates performance tones on the basis of the first and third performance data upon execution of the automatic accompaniment.

According to the automatic arrangement apparatus of the present invention, when it is detected that a melody note is a nonharmonic note, the melody note is converted into a harmonic note, and an additional note (or notes) is generated on the basis of the converted melody note. Therefore, an additional note (or notes) is always selected from harmonic notes of chord.

According to the electronic musical instrument of the present invention, the performance operation member generates first performance data according to a performance operation of a player. The first performance data includes tone pitch data. When the tone pitch data in the first performance data is a nonharmonic tone pitch with respect to a chord in the corresponding tone generation period, the first performance data is converted by the conversion means into second performance data, so that the tone pitch data becomes a harmonic tone pitch. Third performance data representing an additional note (or notes) is generated on the basis of the second performance data. The first and third performance data are produced as actual tones together with automatic accompaniment tones.

BRIEF DESCRIPTION OF THE DRAWINGS

FIG. 10 shows the content of a reduction note table ①;

FIG. 11 shows the content of a reduction note table ②;

DESCRIPTION OF THE PREFERRED EMBODIMENTS

The preferred embodiments of the present invention will be described hereinafter with reference to the accompanying drawings.

Figure 1:
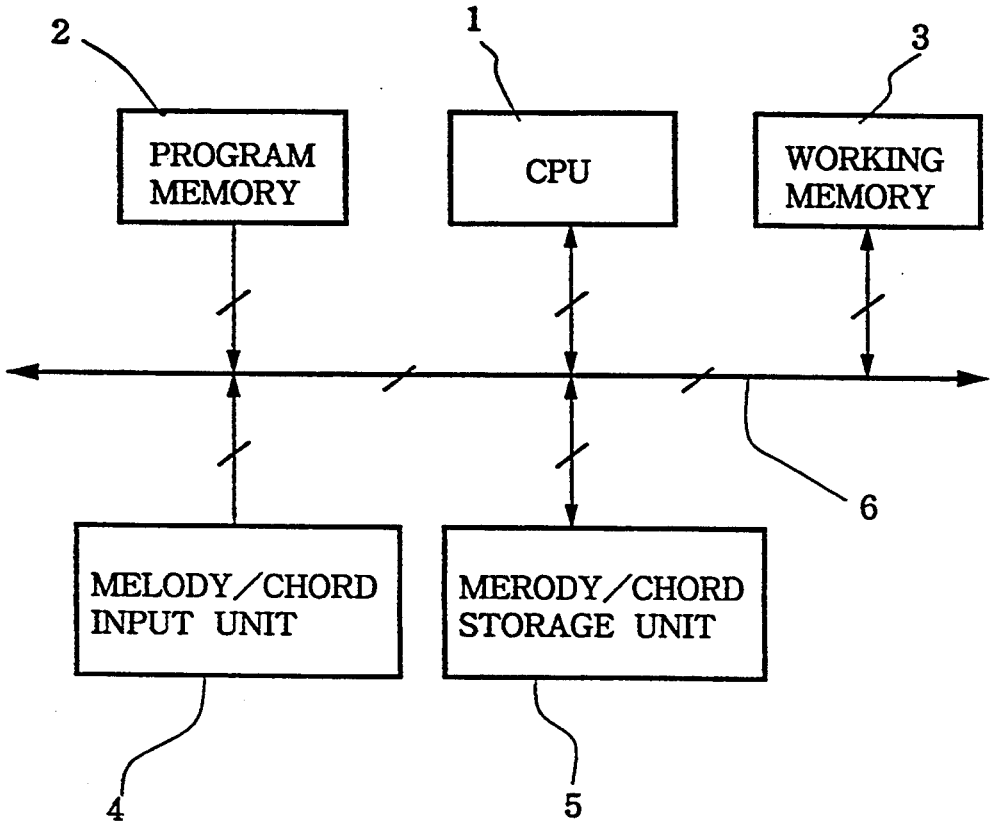
FIG. 1 is a block diagram of an automatic arrangement apparatus according to the first embodiment of the present invention.

FIG. 1 is a block diagram showing an arrangement of an automatic arrangement apparatus according to the first embodiment of the present invention. The automatic arrangement apparatus comprises a central processing unit (CPU) 1 for controlling the operation of the overall apparatus, a program memory 2 for storing a program executed by the CPU 1, a working memory 3 allocated with various registers and flags, a melody/chord input unit 4, and a melody/chord storage unit 5. The melody/chord input unit 4 inputs melody data representing a melody note, and chord data representing a chord. The melody/chord storage unit 5 stores the input melody and chord data. Reference numeral 6 denotes a bus line for connecting these units.

Figure 2:
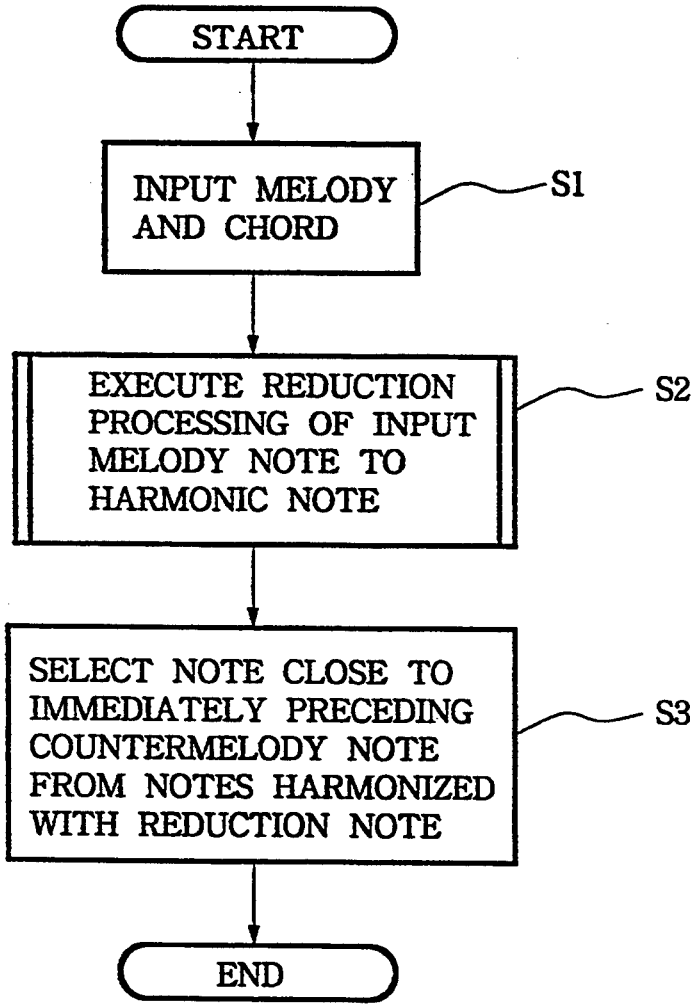
FIG. 2 is a flow chart for explaining the outline of an operation of the automatic arrangement apparatus of the first embodiment.

FIG. 2 is a flow chart for explaining the outline of an operation of the automatic arrangement apparatus of this embodiment.

In the automatic arrangement apparatus, a user inputs melody and chord data representing melody notes and chords as a foundation using the melody/chord input unit 4 (step S1). The input method is not particularly limited. For example, the melody and chord data may be input using a keyboard or a ten-key pad, or data generated in advance by another apparatus may be transferred to the automatic arrangement apparatus according to, e.g., the MIDI standards. The input melody and chord data are stored in the melody/chord storage unit 5.

Then, the melody and chord data stored in the melody/chord storage unit 5 are read out, and reduction processing of input melody notes is executed (step S2). The reduction processing is processing for generating reduction note data. The reduction note data is information representing a reduction note. When a melody note (including a rest) is a rest or a harmonic note, the reduction note is the same note as the given melody note; when the melody note is a nonharmonic note, the reduction note is a note obtained by converting the melody note into a harmonic note according to a predetermined rule. The reduction rule and the structure of reduction note data will be described later.

Then, countermelody notes are generated by sequentially selecting a note having a tone pitch close to that of the immediately preceding countermelody note from notes consonant with a corresponding reduction note using the reduction note data (step S3). Upon completion of generation of the countermelody notes, the processing is ended.

Figure 3A:
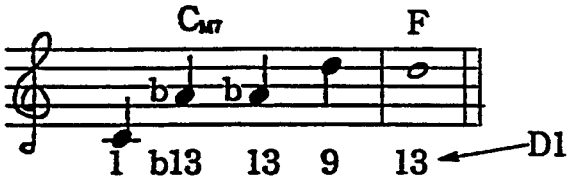
FIGS. 3(*a*) to 3(*c*) show note conversion and generation examples in reduction processing and countermelody generation processing.
Figure 3B:
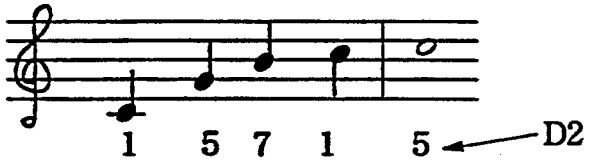
Figure 3C:
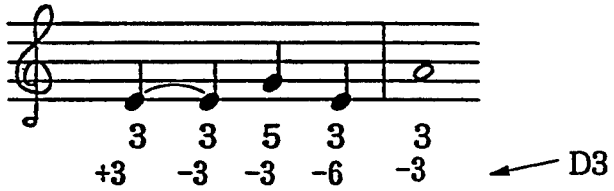

FIGS. 3(*a*) to 3(*c*) show examples of conversion processing and generation processing of notes in the reduction processing in step S2 (FIG. 2) and in countermelody generation processing in step S3. FIG. 3(*a*) shows a melody and chords input by a user. A chord of the first bar is $C_{M7}$ (C major seventh), and a chord of the second bar is F (F major). A numerical value denoted by symbol D1 and corresponding to each melody note is the number of degrees from the root of the chord at that time. This number of degrees will be referred to as a "melody degree count" hereinafter.

When the melody notes shown in FIG. 3(*a*) are reduced, reduction notes shown in FIG. 3(*b*) are obtained. For example, the first note of the melody is "C", and the chord at that time is $C_{M7}$. Therefore, since harmonic notes are "C, E, G, and B", and the first note "C" of the melody is a harmonic note, it is directly used as a reduction note. The second note of the melody is "A♭ ", and is a nonharmonic note. This note is reduced to a harmonic note to obtain a reduction note "G". Similarly, other melody notes are reduced. A numerical value denoted by symbol D2 and corresponding to each reduction note represents the number of degrees from the root of the chord at that time.

FIG. 3(*c*) shows a countermelody generated based on the reduction notes shown in FIG. 3(*b*). In this case, the first note of the countermelody is determined as "E", and the following countermelody notes are generated by sequentially selecting notes a predetermined interval apart from the corresponding reduction notes and each having tone pitch close to the immediately preceding countermelody note. Symbol D3 denotes the number of degrees of each countermelody note from the corresponding reduction note.

The reduction processing rules of melody notes will be described below. A melody includes a nonharmonic note with respect to the chord at that time. It is considered that this nonharmonic note is derivatively generated from a close melody note which is a harmonic note. Conversion of the nonharmonic note into a harmonic note is executed as follows in consideration of the derivation. Note that a melody note of interest to be subjected to reduction processing will be referred to as a "current melody note" hereinafter.

[A] When a chord at the positions of the current melody note and its immediately preceding melody note remains the same:

The following rule (A-1) or (A-2) is applied. (A-1) When a rest is present immediately before the current melody or there is no note since the current melody note is present at the beginning of a music piece:

In this case, the following rule (A-1-a) or (A-1-b) is applied with reference to the immediately succeeding melody note and a chord.

(A-1-a) When a chord at the positions of the current melody note and its immediately succeeding melody note remains the same, the following rules (a) to (c) are applied:

(a) When a melody note immediately after the current melody note is a rest or the end of a music piece, since the current melody note is isolated, a reduction note is obtained with reference to a reduction note table ① on the basis of a chord type at the position of the current melody note and the melody degree count of the current melody note.

FIG. 10 shows the content of the reduction note table ①. The reduction note table ① shows a list of the numbers of degrees from chord roots of reduction notes determined according to chord types in the column direction and melody degree counts in the row direction. The number of degrees of a reduction note from the corresponding chord root will be referred to as a "reduction note degree count" hereinafter. For example, when the melody degree count of a melody note is " #2" (i.e., augmented second) and the chord type is major seventh "M7", the reduction note degree count is "3" with reference to the table of FIG. 10. Therefore, a note a third apart from the chord root is determined as a reduction note.

Figure 4:
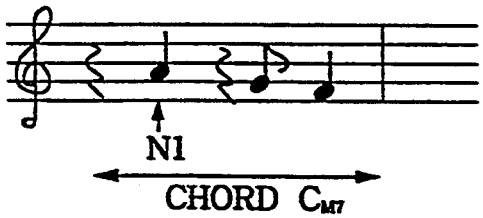
FIG. 4 is a music score (No. 1) for explaining an example of reduction processing.

FIG. 4 shows an example of the rule (a). A current melody note N1 is "A", and a chord at that time is $C_{M7}$. Rests are present immediately before and after the current melody note N1. Thus, the reduction note table ① is looked up on the basis of the melody degree count and chord type (major seventh) of the current melody note N1, thus obtaining a reduction note degree count. A note a reduction note degree count apart from the chord root is the reduction note to be obtained.

(b) When a melody note immediately after the current melody note makes a disjunct motion with respect to the current melody note, the reduction note table ① is looked up on the basis of a chord type at the position of the current melody note and the melody degree count of the current melody note like in the rule (a), thereby obtaining a reduction note. The "disjunct motion" means the relationship between two notes apart by an interval larger than a second.

Figure 5:
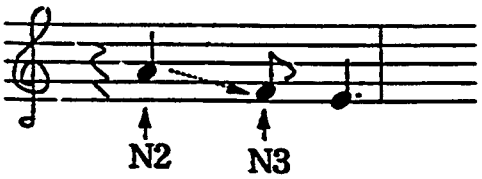
FIG. 5 is a music score (No. 2) for explaining another example of reduction processing.

FIG. 5 shows an example of the rule (b). An interval between a current melody note N2 and its immediately succeeding melody note N3 is a third, and is larger than a second. Thus, the reduction note table ① is looked up on the basis of the melody degree count and chord type of the current melody note N2 to obtain a reduction note degree count, thereby obtaining a reduction note.

(c) When a melody note immediately after the current melody note makes a conjunct motion with respect to the current melody note, it is considered that these notes have a strong relation therebetween. The "conjunct motion" means the relationship between two notes apart by an interval equal to or smaller than a second. In this case, the reduction note table ② is looked up on the basis of a chord type at the position of the current melody note and a transition state of the melody degree count of the current melody note to that of the immediately succeeding melody note, thereby obtaining a reduction note.

In this case, the transition state of the melody degree count of the current melody note to that of the immediately succeeding melody note will be expressed by a concept called "degree progression" hereinafter. The "degree progression" will be mentioned in the form of connecting the melody degree count of the current melody note to that of the immediately succeeding melody note by → (or by ← in the opposite direction). For example, when the melody degree count of the current melody note is "2", and that of the immediately succeeding melody note is "3", the degree progression is represented as "2→3".

FIG. 11 shows the content of a reduction note table ②. The reduction note table ② shows a list of reduction note degree counts determined according to chord types in the column direction and degree progressions in the row direction. All degree counts on the left- and right-hand sides of arrows correspond to each other, and cannot be replaced. In the case of the rule (c), a reduction note degree count to be obtained is a degree count not at the arrowhead side but at the tail side. For example, when the degree progression from the current melody note to the immediately succeeding current melody note is "2→ #2", and a chord type is major seventh "M7", "1→3" is read out from the reduction note table ②. In this case, of the numerical values on the left- and right-hand sides of →, "1" at the tail side of the arrow is a reduction note degree count to be obtained. Conversely, when the degree progression from the current melody note to the immediately succeeding current melody note is "2← #2", and a chord type is major seventh "M7", "1←3" is read out from the reduction note table ②. In this case, of the numerical values on the left- and right-hand sides of ←, "3" at the tail side of the arrow is a reduction note degree count to be obtained.

Figure 6:
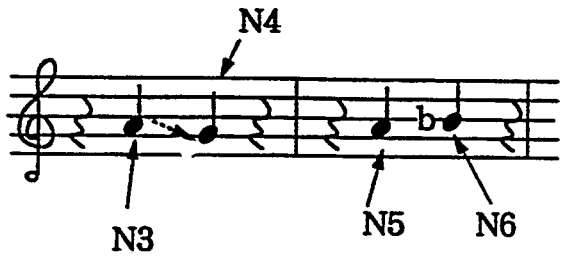
FIG. 6 is a music score (No. 3) for explaining still another example of reduction processing.

FIG. 6 shows an example of the rule (c). An interval between a current melody note N3 and its immediately succeeding melody note N4 is a second, which is equal to or smaller than a second. Thus, a reduction note degree count is obtained by looking up the reduction note table ② on the basis of the degree progression from the current melody note N3 to the immediately succeeding melody note N4 and a chord type, thereby obtaining a reduction note. The same applies to a current melody note N5 and an immediately succeeding melody note N6.

(A-1-b) When chords at positions of the current melody note and its immediately succeeding melody note are changed, the current melody note is considered as an isolated note, and a reduction note is obtained by looking up the reduction note table ① on the basis of a chord type at the position of the current melody note and the melody degree count of the current melody note like in the rules (a) and (b).

Figure 7:
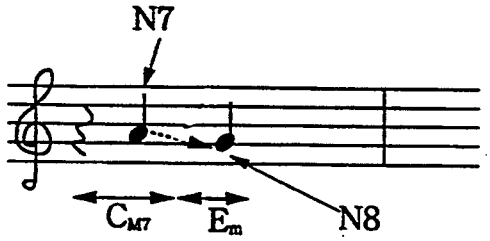
FIG. 7 is a music score (No. 4) for explaining still another example of reduction processing.

FIG. 7 shows an example of the rule (A-1-b). A chord at the position of a current melody note N7 is C major seventh "$C_{M7}$", and a chord at the position of the immediately succeeding melody note N8 is E minor "Em". Thus, chords are changed. A reduction note degree count is obtained by looking up the reduction note table ① on the basis of the melody degree count and chord type of the current melody note N7.

(A-2) When there is a note immediately before the current melody note:

The following rule (d) or (e) is applied.

(d) When the current melody note makes a disjunct motion when viewed from a melody note immediately before the current melody note, the rule (A-1-a) or (A-1-b) is applied with reference to a melody note immediately after the current melody and a corresponding chord.

Figure 8:
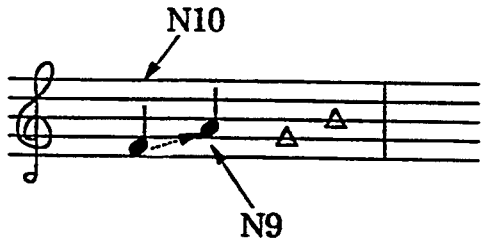
FIG. 8 is a music score (No. 5) for explaining still another example of reduction processing.

FIG. 8 shows an example of the rule (d). A disjunct motion is made from a melody note N10 immediately before a current melody note N9 to the current melody note N9. Thus, the immediately preceding melody note N10 is disregarded, and a reduction note is obtained with reference to the immediately succeeding melody note according to the rule (A-1-a) or (A-1-b).

(e) When the current melody note makes a conjunct motion when viewed from a melody note immediately before the current melody note, a reduction note is obtained by looking up the reduction note table (2) on the basis of a chord type at the position of the current melody note and a degree progression from the immediately preceding melody note to the current melody note.

In the case of the rule (e), a reduction note degree count to be obtained is a degree count not at the tail side but at the arrowhead side of an arrow. For example, when the degree progression from a melody note immediately before the current melody note to the current melody note is "2→ #2", and a chord type is major seventh "M7", "1→3" is read out from the reduction note table (2). In this case, of the numerical values on the left- and right-hand sides of →, "3" at the arrowhead side of the arrow is a reduction note degree count to be obtained. Conversely, when the degree progression from the current melody note to the immediately succeeding current melody note is "2← #2", and a chord type is major seventh "M7", "1←3" is read out from the reduction note table (2). In this case, of the numerical values on the left- and right-hand sides of ←, "1" at the arrowhead side of the arrow is a reduction note degree count to be obtained.

Figure 9:
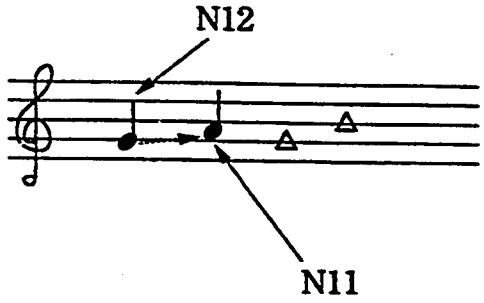
FIG. 9 is a music score (No. 6) for explaining still another example of reduction processing.

FIG. 9 shows an example of the rule (e). An interval between a current melody note N11 and its immediately preceding melody note N12 is a second, which is equal to or smaller than a second. Thus, a reduction note degree count is obtained by looking up the reduction note table (2) on the basis of the degree progression from the immediately preceding melody note N12 to the current melody note N11 and a chord type, thereby obtaining a reduction note.

[B] When chords at the positions of the current melody note and its immediately preceding melody note are changed:

A change in chord at the position of the current melody note means that the flow of a melody is renewed from here, and it can be considered that notes before and after the chord is changed have no relationship therebetween. Even when melody notes make a conjunct motion, if a chord is changed, the flow of harmonic and nonharmonic notes is disconnected here. Therefore, when a chord is changed at the position of the current melody note, processing can be made under an assumption that there is no immediately preceding note. More specifically, the rule (A-1-a) or (A-1-b) is applied with reference to a melody note immediately after the current melody note.

Figure 12:
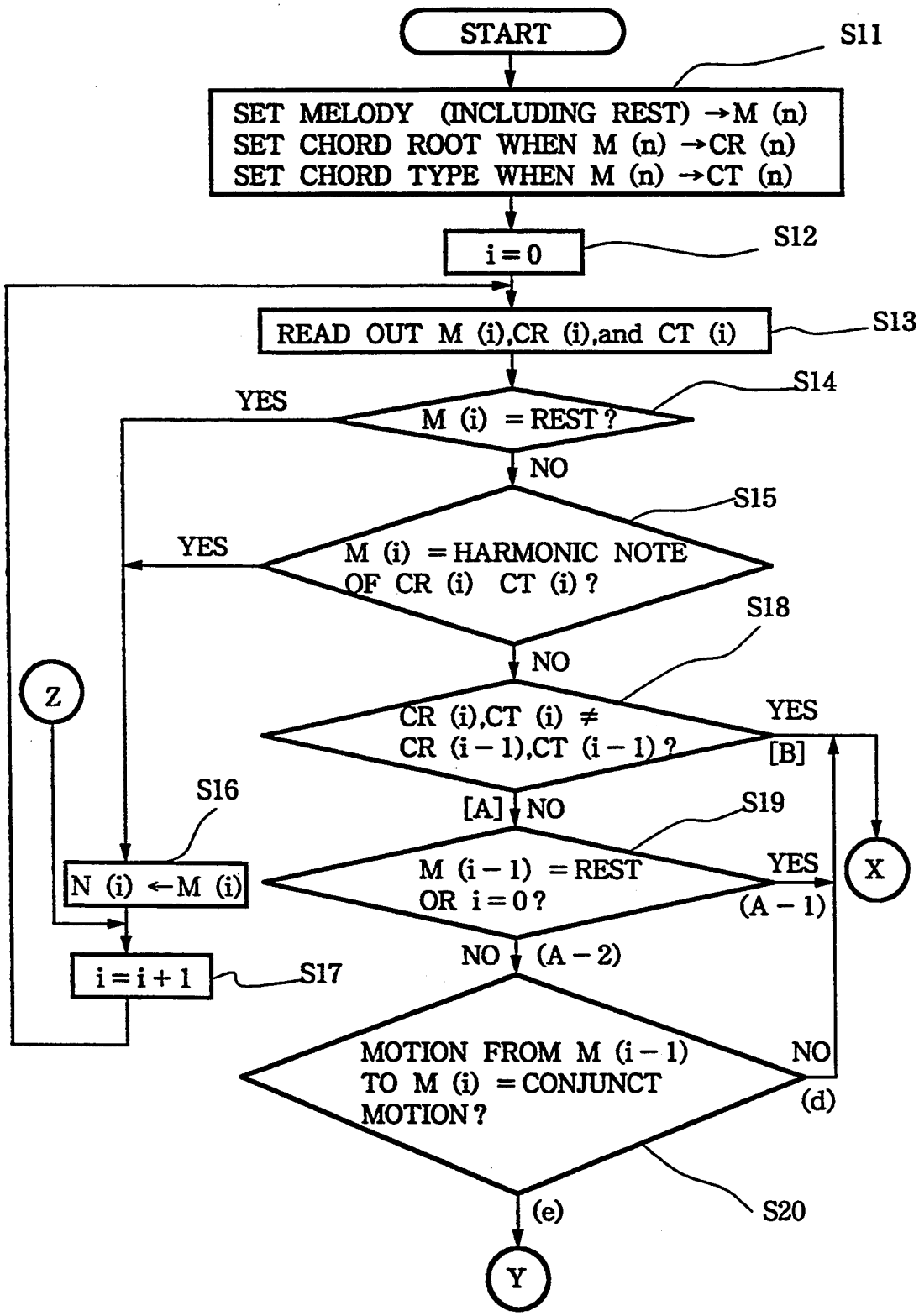
FIG. 12 is a flow chart showing reduction processing routine (Part 1)
Figure 13:
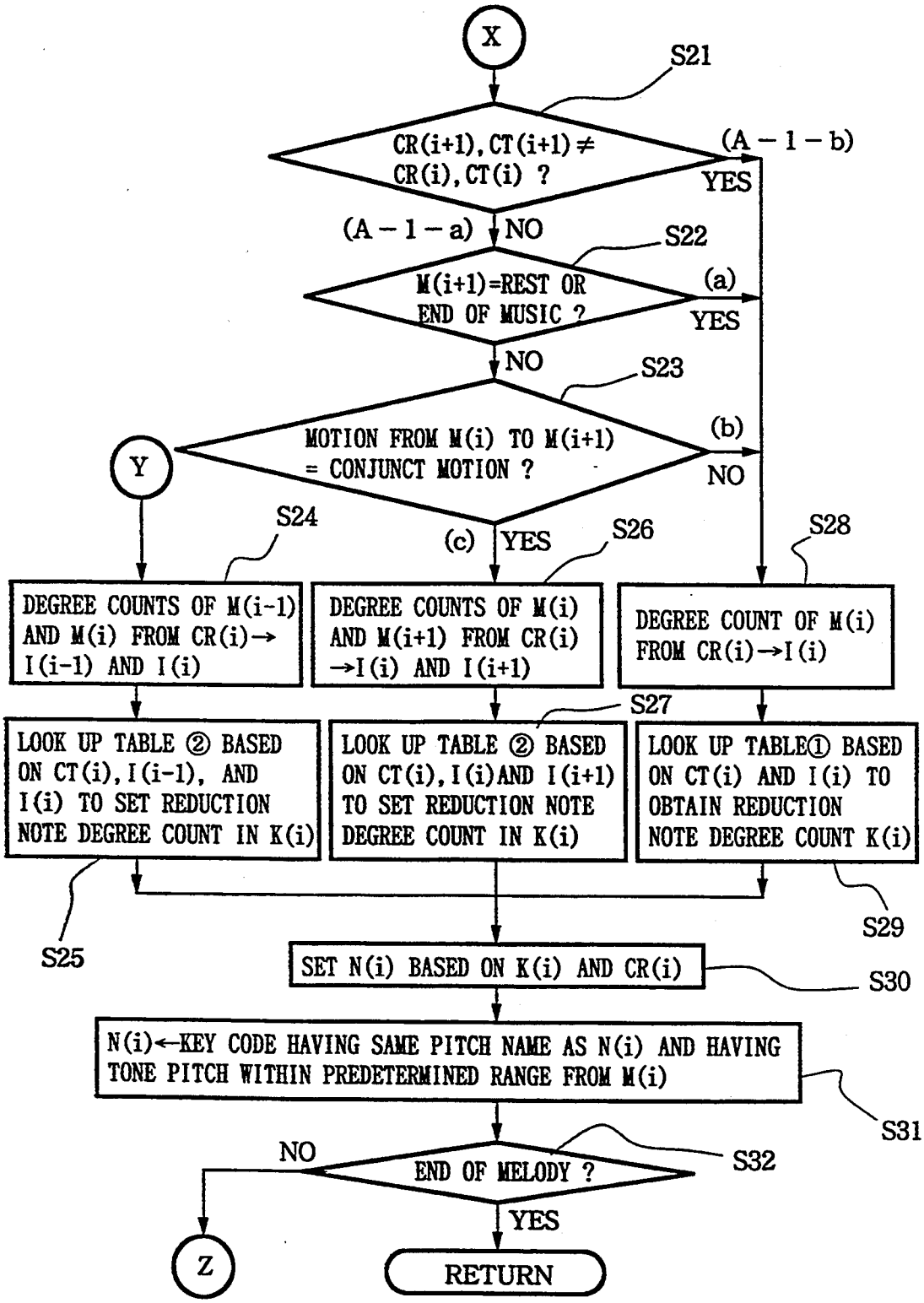
FIG. 13 is a flow chart showing reduction processing routine (Part 2)

The above-mentioned reduction processing rules of melody notes are reflected in the flow charts shown in FIGS. 12 and 13 to be described later.

Registers and the like used in the automatic arrangement apparatus of this embodiment will be described below.

(a) M(i): Array type registers for storing melody data representing melody notes. i=0, 1, 2, . . . , and data representing a tone pitch or rest of an i-th melody note is stored in the register M(i).

(b) CR(i): Chord root registers. These registers are array type registers. i=0, 1, 2, . . . , and data representing the root of a chord at the position of an i-th melody note is stored in the register CR(i).

(c) CT(i): Chord type registers. These registers are array type registers. i=0, 1, 2, . . . , and data representing a type of a chord at the position of an i-th melody note is stored in the register CT(i).

(d) I(i): Melody degree count registers. These registers are array type registers. i=0, 1, 2, . . . , and melody degree count data of an i-th melody note is stored in the register I(i).

(e) K(i): Reduction note degree count registers. These registers are array type registers. i=0, 1, 2, . . . , and reduction note degree count data of an i-th melody note is stored in the register K(i).

(f) N(i): Reduction note registers. These registers are array type registers. i=0, 1, 2, . . . , and reduction note data (tone pitch data of a reduction note) obtained by reducing an i-th melody note is stored.

Note that the above-mentioned symbols represent registers, and data stored therein. For example, N(i) represents the reduction note register, and also represents reduction note data stored in the reduction note register.

The sequence of the reduction processing in step S2 in FIG. 2 will be described in detail below with reference to the flow charts shown in FIGS. 12 and 13. In order to show correspondences between the flow charts and the various cases described in the paragraphs of the reduction processing rules, [A], (A-1), (a), and the like assigned to the paragraphs of the reduction processing rules are also assigned to the corresponding portions in FIGS. 12 and 13.

In the reduction processing, input melody and chord data are read out in step S11. Melody data (including a rest) is set in the melody register M(n) (n=0, 1, 2, . . . ), the root of a chord at the position of an n-th melody note M(n) is set in a chord root register CR(n), and the type of the chord at the position of the n-th melody note M(n) is set in a chord type register CT(n).

In step S12, "0" is set in a work register i, and the flow then advances to step S13. In step S13 and subsequent steps, reduction of an i-th melody note (current melody note) is executed, i.e., generation of reduction note data and setting of the generated reduction note data in the register N(i) are executed, while incrementing the content of the work register i.

In step S13, melody data M(i), chord root data CR(i), and chord type data CT(i) are read out, and in step S14, it is checked if the melody data M(i) is a rest. If YES in step S14, since this melody data can be directly used as reduction note data, the melody data M(i) is set in the reduction note register N(i) in step S16, and the content of the work register i is incremented by 1 in step S17. Thereafter, the flow returns to step S13.

However, if NO in step S14, it is checked in step S15 if the melody data M(i) represents a harmonic note of a chord (a chord specified by the chord root data CR(i) and the chord type data CT(i)) at that position. If YES in step S15, since this melody data can be directly used as reduction note data, the flow advances to step S16.

However, if NO in step S15, it is checked in step S18 if the chord root data CR(i) and the chord type data CT(i) of the current melody note of interest are different from chord root data CR(i−1) and chord type data CT(i−1) of its immediately preceding melody note. This is to check whether or not the chord at the position of the current melody note is the same as that at the position of the immediately preceding melody note. If NO in step S18 (the case of [A] described above), the flow advances to step S19; otherwise (the case of [B] described above), the flow advances to step S21. If i=0, and CR(i−1) and CT(i−1) are not present, the flow advances to step S19.

It is checked in step S19 if melody data M(i−1) is a rest or i=0, i.e., if a rest is present immediately before the current melody note or there is no note since the current melody note is present at the beginning of a music piece. If YES in step S19 (the case of (A-1) described above), the flow advances to step S21; otherwise (the case of (A-2) described above), the flow advances to step S20. It is checked in step S20 if a conjunct motion is made from the melody data M(i−1) to the melody data M(i). If NO in step S20, since it is determined that a disjunct motion is made (the case of (d) described above), the flow advances to step S21; otherwise (the case of (e) described above), the flow advances to step S24.

In step S21, it is checked if the chord root data CR(i) and the chord type data CT(i) of the current melody note are different from chord root data CR(i+1) and chord type data CT(i+1) of its immediately succeeding melody note. This is to check whether or not a chord at the position of the current melody note is the same as that at the position of the immediately succeeding melody note. If NO in step S21 (the case of (A-1-a) described above), the flow advances to step S22; otherwise (the case of (A-1-b) described above), the flow advances to step S28.

In step S22, it is checked if melody data M(i+1) is a rest or there is no note, i.e., if a rest is present immediately after the current melody note, or the current melody note is present at the end of a music piece. If YES in step S22 (the case of (a) described above), the flow advances to step S28; otherwise, the flow advances to step S23. In step S23, it is checked if a conjunct motion is made from the melody data M(i) to the melody data M(i+1). If NO in step S23, since this means that a disjunct motion is made (the case of (b) described above), the flow advances to step S28; otherwise (the case of (c) described above), the flow advances to step S26.

In step S28, the number of degrees of the melody data M(i) from the chord root data CR(i), i.e., the melody degree count of the current melody note is calculated, and is set in the melody degree count register I(i). In step S29, a reduction note degree count is obtained by looking up the reduction note table ① on the basis of the chord type CT(i) at the position of the current melody note and the melody degree count I(i) of the current melody note, and is set in the reduction note degree count register K(i). Thereafter, the flow advances to step S30.

In step S26, the numbers of degrees of the melody data M(i) and M(i+1) from the chord root CR(i), i.e., the melody degree count of the current melody note and the melody degree count of a melody note immediately after the current melody note are calculated, and are respectively set in the melody degree count registers I(i) and I(i+1). In step S27, a reduction note degree count is obtained by looking up the reduction note table ② on the basis of the chord type CT(i) at the position of the current melody note and the melody degree counts I(i) and I(i+1) of the current melody note and its immediately succeeding melody note, and is set in the reduction note degree count register K(i). Then, the flow advances to step S30. As described above, in this look-up processing of the reduction note table ②, reduction note degree count data is read out from the tail side of an arrow.

In step S24, the numbers of degrees of the melody data M(i−1) and M(i) from the chord root CR(i), i.e., the melody degree count of the current melody note and the melody degree count of a melody note immediately before the current melody note are calculated, and are respectively set in the melody degree count registers I(i) and I(i−1). In step S25, a reduction note degree count is obtained by looking up the reduction note table ② on the basis of the chord type CT(i) at the position of the current melody note and the melody degree counts I(i) and I(i−1) of the current melody note and its immediately preceding melody note, and is set in the reduction note degree count register K(i). Then, the flow advances to step S30. As described above, in this look-up processing of the reduction note table ②, reduction note degree count data is read out from the arrowhead side of an arrow.

In step S30, the tone pitch of the reduction note is obtained on the basis of the chord root CR(i) and the reduction note degree count K(i), and is set in the reduction note register N(i). In step S31, a key code which has the same pitch name as that of the reduction note data N(i) and whose pitch is included within a predetermined range from the melody data M(i) is obtained, and is set in the reduction note data N(i). In step S32, it is checked if the processing reaches the end of the melody (the end of the music piece). If NO in step S32, the flow returns to step S17; otherwise, the flow returns to the main routine.

Note that a key code representing a tone pitch is stored in each of the melody data register M(i), the chord root register CR(i), and the reduction note register N(i). The key code is expressed in the internal processing in such a manner that notes having a pitch name "C" are expressed by integer multiples of "12" from the lower tone pitch, and notes between the notes of the pitch name "C" are expressed by values which are incremented by "1" at every halfnote. Therefore, values stored as the melody degree count I(i) and the reduction note degree count K(i) are expressed by differences of these key codes in the internal processing. For example, in FIGS. 10 and 11 described above, intervals are expressed by the number of degrees. However, actual table data are expressed by differences of key codes. That is, a perfect prime is expressed by "0"; an augmented prime (minor second) is expressed by "1", a major second is expressed by "2", . . . , a perfect octave is expressed by "12", . . . .

Therefore, in the actual processing, the degree count I(i) is calculated in step S25, S27, or S29 using the following formula:

$$I(i)=(M(i)-CR(i)) \bmod 12$$

The reduction note N(i) is calculated in step S30 using the following formula:

$$N(i)=(K(i)+CR(i)) \bmod 12$$

In step S31, a key code having the same pitch name as that of the reduction note N(i) and satisfying "$-5 \leqq M(i) \leqq 6$" is rewritten with the reduction note N(i).

Each reduction note data N(i) obtained as described above is a harmonic note of a chord at the corresponding position. Therefore, a countermelody, which is generated using the reduction note data N(i) in step S3 in FIG. 2, can be harmonized with a melody without giving a musically unstable sense. The generated countermelody data is preferably recorded/reproduced in a format of automatic performance data, but may be displayed on a display device such as a CRT in a form of a score or may be printed out by a printer. Alternatively, the reduction note data N(i) may be recorded/reproduced or displayed.

The second embodiment of the present invention will be described below. An automatic arrangement apparatus of the second embodiment has the same arrangement as that shown in FIG. 1, and adopts a processing sequence shown in FIG. 14.

Figure 14:
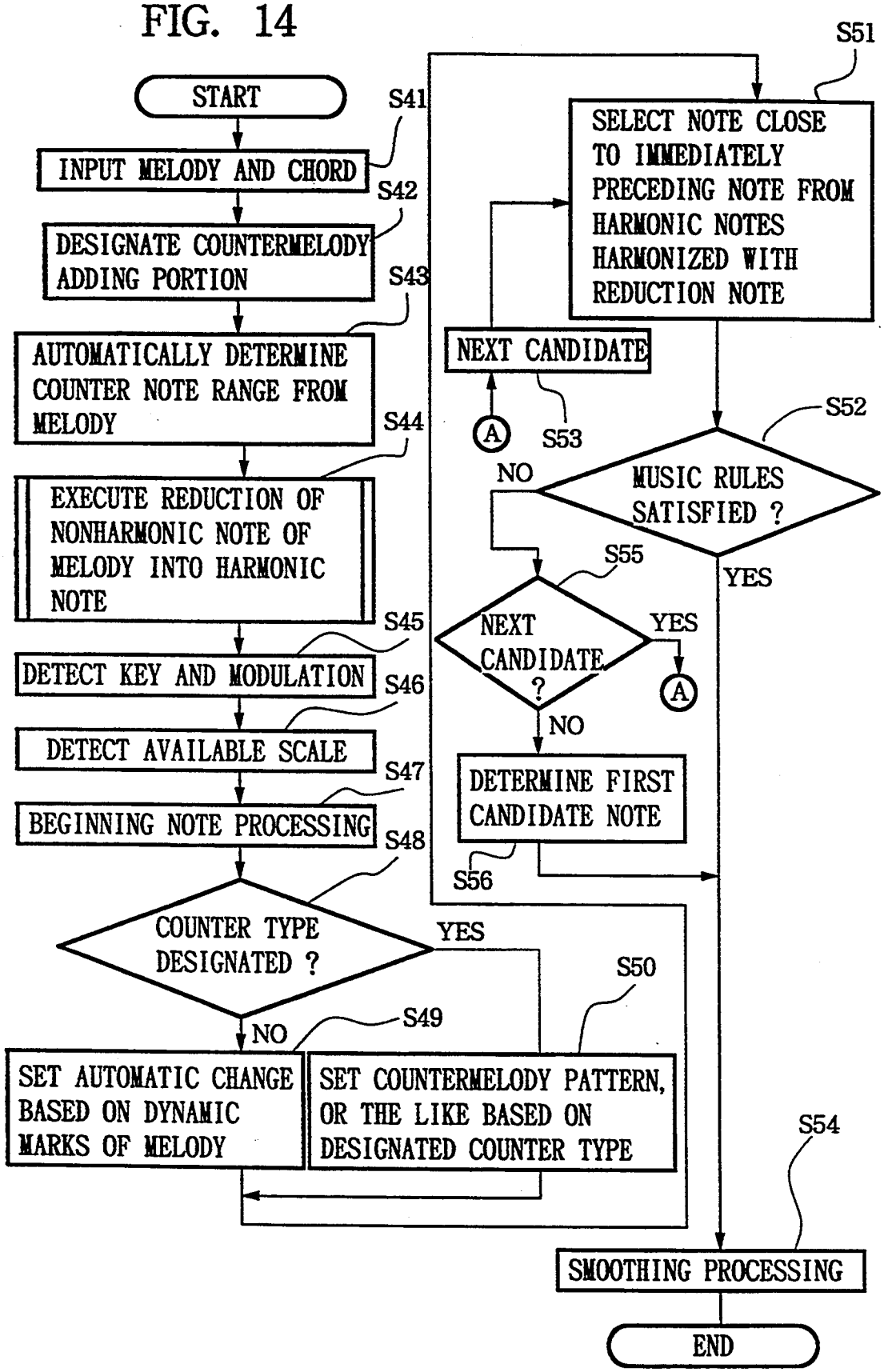
FIG. 14 is a flow chart showing an operation of an automatic arrangement apparatus according to the second embodiment of the present invention.

Referring to FIG. 14, in this automatic arrangement apparatus, melody and chord data representing melody notes and harmonic notes as a foundation are inputted using a melody/chord input unit 4 in step S41 like in step S1 in FIG. 2. In step S42, a portion where a countermelody is to be added is designated. The portion where the countermelody is to be added may be manually designated by a user, or may be automatically determined such that a countermelody is started from a position where a melody phrase is discontinued.

In step S43, a countermelody note range is automatically determined on the basis of melody and chord data. In this processing, a countermelody note range, e.g., lower by one octave than melody notes is determined. In step S44, processing for reducing nonharmonic notes of the melody into harmonic notes is executed. This processing is the same as that shown in FIGS. 12 and 13 described above.

In step S45, the key of a music piece and the presence/absence of modulation are detected on the basis of melody and chord data. In step S46, an available scale is detected according to the detected key and modulation information. The reason why the available scale is detected is that the detected available scale is used in smoothing processing to be described later.

In step S47, beginning note processing is executed. In this processing, a rest is inserted at the beginning of a music piece in order to delay the start timing of a countermelody. In a normal music piece, since a rest is inserted at the beginning of a countermelody, the rest is inserted in this processing. It is then checked if a counter type is designated by a user. The counter type designates a pattern, tonality, note range, or the like of a countermelody. When no counter type is designated, an automatic change in countermelody according to dynamic marks of a melody is set. If it is determined in step S48 that the counter type is designated, a pattern, tonality, note range, or the like of the countermelody is set on the basis of the designated information.

In step S51, harmonic notes harmonized with a reduction note are picked up in the following priority order. The order includes a major third, a minor third, a perfect fourth, a perfect fifth, a major sixth, a minor sixth, and a major second (below the reduction note). In step S52, it is checked if a selected countermelody note satisfies predetermined music rules. The music rules are normal rules such as a rule of avoiding a countermelody parallel to a melody, a rule of avoiding a note having a minor ninth relationship with a melody note, and the like. If it is determined in step S52 that the selected note does not satisfy the music rules, it is checked in step S55 if there is the next candidate. If YES in step S55, the next candidate of a countermelody note is specified, and the flow returns to step S51. However, if NO in step S55, the first candidate note is determined as a countermelody note in step S56. The flow then advances to step S54.

If it is determined in step S52 that the selected note satisfies the music rules, smoothing processing is executed in step S54, thus ending processing. In the smoothing processing, when two adjacent countermelody notes make a disjunct motion, they are interpolated to fill additional notes therebetween so as to obtain a smooth motion.

Figure 15:
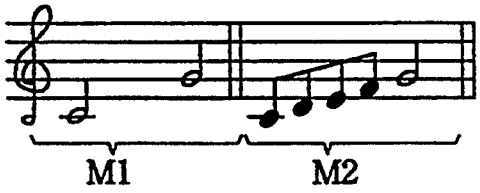
FIG. 15 is a music score showing an example of smoothing processing.

FIG. 15 shows an example of smoothing processing. As in a bar denoted by symbol M1, assume that "C" and "G" are selected as countermelody notes. In this case, in the smoothing processing in step S54, it is determined that a disjunct motion is made from the note "C" to the note "G", and eighth notes are filled between these notes using the available scale (detected in step S46). As a result of the smoothing processing, a bar denoted by symbol M2 is obtained.

In the second embodiment, it may be checked if an input chord is a 1-chord/1-note type or a 1-chord/n-note type (n is an integer equal to or larger than 2) so as to determine according to the frequency of notes if a music piece is a slow or hot one. Based on this determination result, the way of selecting countermelody tones may be changed.

According to the second embodiment, since processing operations for properly generating countermelody notes, such as processing for designating an adding portion and a note range of a countermelody, smoothing processing, and the like, are executed, various countermelodies can be flexibly generated. In this embodiment, the available scale is detected. It is more preferable to form additional notes such as countermelody notes including nonharmonic notes matching with the music theory by utilizing the available scale.

In each of the first and second embodiments, chord data is inputted by a user as well as melody data. However, chord data may be automatically generated based on melody data. When a melody note is a rest or a harmonic note, a reduction note is determined as the same note as the melody note. However, a harmonic note different from the melody note may be selected. Furthermore, data to be inputted is not limited to a so-called melody, but may be a secondary melody or a melody of a bass performance.

In each of the above embodiments, a countermelody is added below a melody, but may be added above a melody. In this case, the same processing as described above can be performed as long as upper harmonic note candidates and the upper limit are determined.

An electronic musical instrument according to the third embodiment of the present invention will be described below. This electronic musical instrument generates countermelody notes for a performance of a player in real time by utilizing the above-mentioned automatic arrangement apparatus according to the present invention, and produces tones based on the generated notes.

Figure 16:
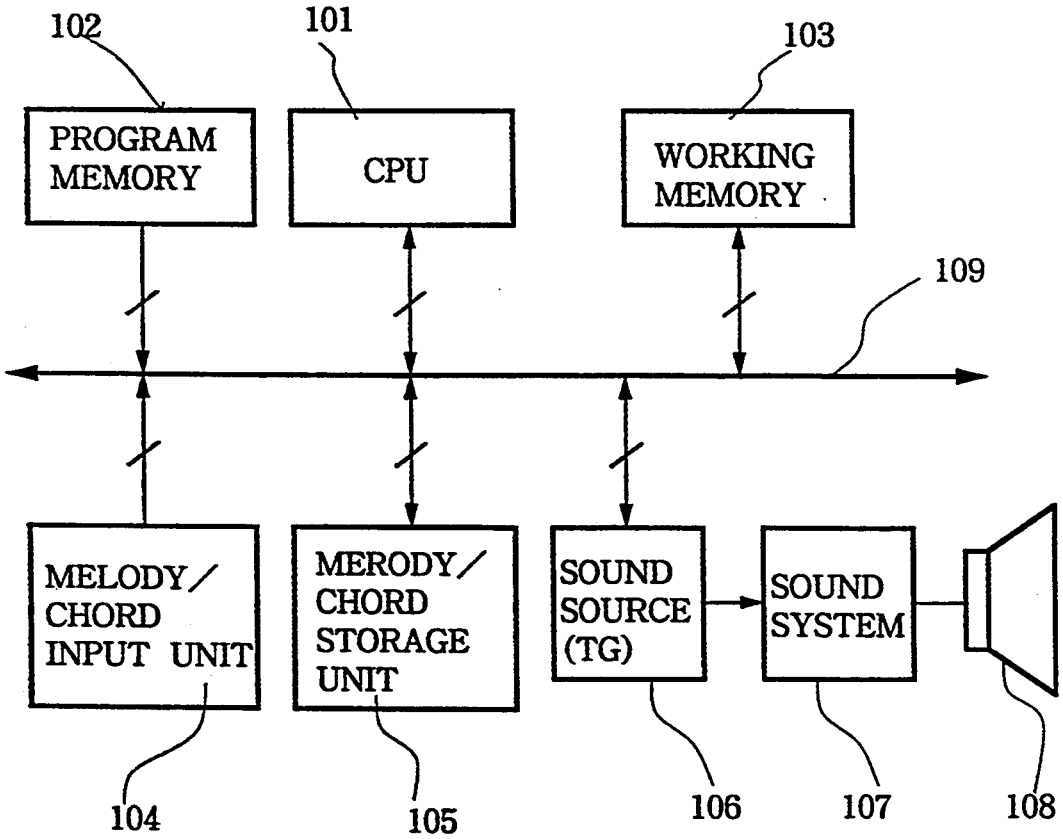
FIG. 16 is a block diagram showing an electronic musical instrument according to the third embodiment of the present invention.

FIG. 16 is a block diagram showing the electronic musical instrument according to the third embodiment of the present invention. The electronic musical instrument comprises a central processing unit (CPU) 101, a program memory 102 for storing a program to be executed by the CPU 101, a working memory 103 allocated with various registers and flags, a melody/chord input unit 104, a melody/chord storage unit 105, a sound source 106, a sound system 107, and a loudspeaker 108.

The melody/chord input unit 104 is a keyboard operated by a player. Upon operation of the keyboard 104, melody data representing melody notes and chord data representing chords are inputted. In the electronic musical instrument of this embodiment, melody data is inputted using the right key region of the keyboard 104, and chord data is inputted using the left key region thereof.

The melody/chord storage unit 105 stores the input melody and chord data. The sound source 106 generates musical tone signals according to an instruction from the CPU 101, and inputs the signals to the sound system 107. The sound system 107 produces actual tones from the loudspeaker 108 on the basis of the input musical tone signals. Reference numeral 109 denotes a bus line for connecting these units.

Figure 17:
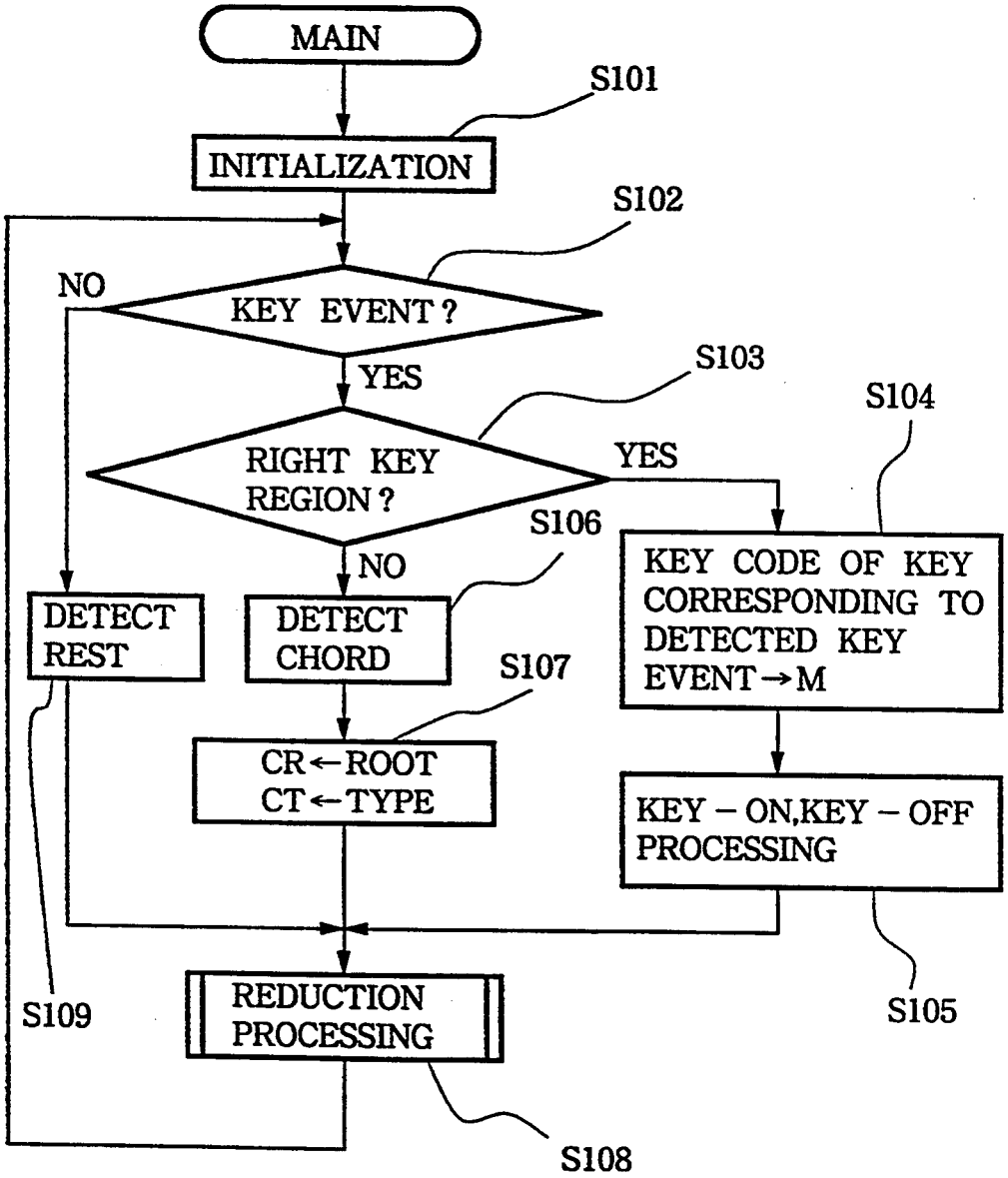
FIG. 17 is a flow chart showing the main routine of the electronic musical instrument of the third embodiment.

FIG. 17 is a flow chart for explaining the outline of an operation of the electronic musical instrument of this embodiment. When the operation is started, initialization is performed in step S101. Thereafter, it is checked in step S102 if a key event of the keyboard 104 is detected. If YES in step S102, it is checked in step S103 if the detected key event is a key event on the right key region. If YES in step S103, a key code of a key corresponding to the detected key event is set in a register M, and key-ON or key-OFF processing is performed in step S105. Thus, a melody tone corresponding to the key depressed in the right key region is produced. Thereafter, the flow advances to step S108.

However, if NO in step S103, a chord is detected in step S106. In step S107, the root of the detected chord is set in a register CR, and a type of the detected chord is set in a register CT. The flow then advances to step S108. If no key event is detected in step S102, a rest is to be detected in step S109. If a rest is detected, a key code representing the rest is set in the register M, and the flow advances to step S108.

In step S108, reduction processing is executed, and the flow returns to step S102. The reduction processing in step S108 is the same as that in the first and second embodiments described above. That is, in this processing, a reduction note is obtained on the basis of the melody note and chord of the depressed key, and a countermelody note is generated based on the obtained reduction note. Furthermore, in this embodiment, a tone corresponding to the generated countermelody note is produced in real time together with a tone played by a player. This electronic musical instrument comprises an automatic accompaniment function, and automatic accompaniment tones are produced according to a performance of a player.

Figure 18:
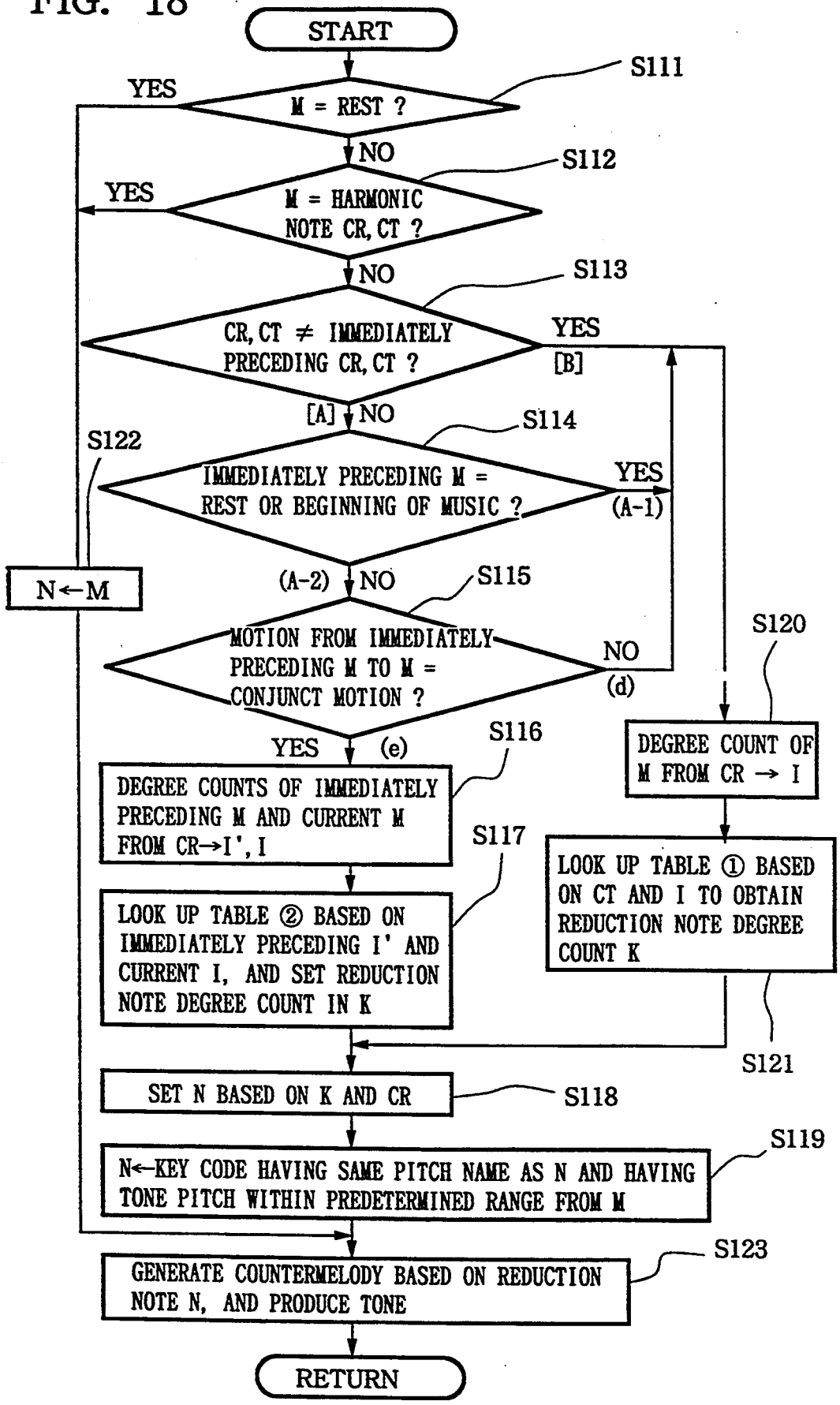
FIG. 18 is a flow chart of a reduction processing routine of the third embodiment.

The reduction processing in step S108 in FIG. 17 will be described in detail below with reference to the flow chart shown in FIG. 18. In order to show correspondences between the flow charts and the various cases described in the paragraphs of the reduction processing rules, [A], (A-1), (a), and the like assigned to the paragraphs of the reduction processing rules are also assigned to the corresponding portions in FIG. 18 like in FIGS. 12 and 13.

In the reduction processing, it is checked in step S111 if melody data M (data set according to a performance of a player in step S104) is a rest. If YES in step S111, since this data can be directly used as reduction note data, the melody data M is set in a reduction note register N in step S122, and the flow advances to step S123.

If NO in step S111, it is checked in step S112 if the melody data M is a harmonic note of a chord (a chord specified by a chord root CR and a chord type CT) at that position. If YES in step S112, since this data an be directly used as reduction note data, the flow advances to step S122.

However, if NO in step S112, it is checked in step S113 if the chord root CR and chord type CT of the current note are different from a chord root and a chord type of its immediately preceding note. This is to check whether or not the present chord is the same as the immediately preceding chord. If YES in step S113 (the case of [A] described above), the flow advances to step S114; otherwise (the case of [B]described above), the flow advances to step S120.

In step S114, it is checked if a rest is present immediately before the current melody note or there is no note since the current melody note is present at the beginning of a music piece. If YES in step S114 (the case of (A-1) described above), the flow advances to step S120; otherwise (the case of (A-2) described above), the flow advances to step S115. In step S115, it is checked if a conjunct motion is made from the immediately preceding melody data to the current melody data M. If NO in step S115, since it is determined that a disjunct motion is made (the case of (d) described above), the flow advances to step S120; otherwise (the case of (e) described above), the flow advances to step S116.

In step S120, the number of degrees of the current melody data M from the chord root CR is calculated, and is set in a melody degree count register I. In step S121, a reduction note degree count is obtained by looking up the reduction note table ① on the basis of the current chord type CT and the melody degree count I, and is set in a reduction note register K. Then, the flow advances to step S118.

In step S116, the numbers of degrees of the immediately preceding melody data and the current melody data M from the chord root CR are calculated, and are respectively set in melody degree count registers I' and I. In step S117, a reduction note degree count is obtained by looking up the reduction note table ② on the basis of the current chord type CT and the melody degree counts I and I' of the current melody note and the immediately preceding melody note, and is set in the reduction note degree count register K. The flow then advances to step S118.

In step S118, the tone pitch of the reduction note is obtained on the basis of the chord root CR and the reduction note degree count K, and is set in the reduction note register N. In step S119, a key code which has the same pitch name as that of the reduction note data N and whose pitch is included within a predetermined range from the melody data M is obtained, and is set in the reduction note data N. The flow then advances to step S123.

In step S123, a countermelody note is generated on the basis of the reduction note N, and a corresponding tone is produced. Thereafter, the flow returns to the main routine. If a tone generation timing is not reached, i.e., if there is no countermelody note to be produced as a tone, no tone generation is performed.

Note that the melody data M, the chord root CR, and the reduction note N are registers (or data) corresponding to the melody data M(i), the chord root CR(i), and the reduction note N(i) in the first embodiment. In the third embodiment, these registers are not of an array type since processing is performed in real time according to a performance of a player. However, since immediately preceding data may often be used, registers for storing immediately preceding data are prepared.

As described above, reduction note data N is generated, a countermelody note is generated using this data, and a corresponding tone is produced. Therefore, countermelody tones harmonized with melody tones can be produced without giving any musically unstable sense.

As described above, according to the present invention, when it is detected that a melody note is a nonharmonic note, the melody note is converted into a harmonic note to obtain reduction note information, and an additional note is determined based on the reduction note information. Therefore, the determined additional note can be harmonized with the melody note without giving any musically unstable sense upon destruction of a chord by the additional note. Proper additional tones are produced in real time according to a performance of a player.

What is claimed is:

1. An automatic arrangement apparatus for performing an automatic arrangement, comprising:

providing means for providing a melody comprising a sequence of plural notes, said melody having a chord progression comprising at least one chord;

detecting means for detecting a nonharmonic note which has a nonharmonic relationship with said chord from among said sequence of plural notes; and conversion means for converting said nonharmonic note to a harmonic note which has a harmonic relationship with said chord.

2. An apparatus according to claim 1, wherein said conversion means converts said nonharmonic note to the harmonic note according to said chord and said nonharmonic note.

3. An apparatus according to claim 1, wherein said conversion means converts said nonharmonic note to said harmonic note according to said chord, said nonharmonic note and an adjacent note which is distant from said nonharmonic note by a semitone interval.

4. An apparatus according to claim 1, wherein when chords at positions of a current melody note and an immediately preceding melody note are the same, and when a rest is present immediately before the current melody note or there is no note since the current melody note is present at the beginning of a music piece, and when chords at positions of the current melody note and an immediately succeeding melody note are the same, and when a melody note immediately after the current melody note is a rest or the current melody note is present at the end of the music piece, said conversion means executes conversion to the harmonic note on the basis of a type of chord at the position of the current melody note and an interval between the current melody note and a chord root.

5. An apparatus according to claim 1, wherein when chords at positions of a current melody note and an immediately preceding melody note are the same, and when a rest is present immediately before the current melody note or there is no note since the current melody note is present at the beginning of a music piece, and when chords at positions of the current melody note and an immediately succeeding melody note are the same, and when an interval between the current melody tone and the immediately succeeding melody note exceeds a predetermined value, said conversion means executes conversion to the harmonic note on the basis of a type of chord at the position of the current melody note and an interval between the current melody note and a chord root.

6. An apparatus according to claim 1, wherein when chords at positions of a current melody note and an immediately preceding melody note are the same, and when a rest is present immediately before the current melody note or there is no note since the current melody note is present at the beginning of a music piece, and when chords at positions of the current melody note and an immediately succeeding melody note are the same, and when an interval between the current melody tone and the immediately succeeding melody note is not more than a predetermined value, said conversion means executes conversion to the harmonic note on the basis of a type of chord at the position of the current melody note and a transition state of an interval between the current melody note and a chord root to an interval between the immediately succeeding melody note and the chord root.

7. An apparatus according to claim 1, wherein when chords at positions of a current melody note and an immediately preceding melody note are the same, and when a rest is present immediately before the current melody note or there is no note since the current melody note is present at the beginning of a music piece, and when chords at positions of the current melody note and an immediately succeeding melody note are different, said conversion means executes conversion to the harmonic note on the basis of a type of chord at the position of the current melody note and an interval between the current melody note and a chord root.

8. An apparatus according to claim 1, wherein when chords at positions of a current melody note and an immediately preceding melody note are the same, and when a note is present immediately before the current melody note, and when an interval between the current melody tone and the immediately preceding melody note exceeds a predetermined value, said conversion means executes conversion to the harmonic note with reference to the melody note and a chord immediately after the current melody note.

9. An apparatus according to claim 1, wherein when chords at positions of a current melody note and an immediately preceding melody note are the same, and when a note is present immediately before the current melody note, and when an interval between the current melody tone and the immediately succeeding melody note is not more than a predetermined value, said conversion means executes conversion to the harmonic note on the basis of a type of chord at the position of the current melody note and a transition state of an interval between the current melody note and a chord root to an interval between the immediately succeeding melody note and the chord root.

10. An apparatus according to claim 1, wherein when chords at positions of a current melody note and an immediately preceding melody note are different, said conversion means executes conversion to the harmonic note with reference to the melody note and a chord immediately after the current melody note.

11. An apparatus according to claim 1, further comprising:

a table which stores intervals of harmonic notes from chord roots, each of the harmonic notes being determined according to a type of chord at a position of a current melody note and an interval between a current melody note and a chord root.

12. An apparatus according to claim 1, further comprising:

a table which stores intervals of harmonic notes from chord roots, each of the harmonic notes being determined according to a type of chord at a position of a current melody note and a transition state of an interval between the current melody note and a chord root to an interval between an immediately succeeding melody note and the chord root.

13. An apparatus according to claim 1, further comprising:

a table which stores intervals of harmonic notes from chord roots, each of the harmonic notes being determined according to a type of chord at a position of a current melody note and a transition state of an interval between an immediately preceding melody note and a chord root to an interval between the current melody note and the chord root.

14. An apparatus according to claim 1, further comprising:

means for generating an additional tone on the basis of said converted nonharmonic melody note.

15. An apparatus according to claim 14, further comprising:

means for designating a range in which an additional tone is added by said means for generating an additional tone.

16. An apparatus according to claim 14, further comprising:

means for determining a note range of an additional note added by said means for generating an additional tone.

17. An apparatus according to claim 1, further comprising:

means for detecting an available scale on the basis of the melody sequence of plural notes and the chord progression, and wherein said means for generating the additional note forms the additional note on the basis of the detected available scale.

18. An electronic musical instrument for performing an automatic accompaniment on the basis of a designated chord, comprising:

a performance operation member for generating first performance data including tone pitch data according to a performance operation of a player;

conversion means for, when tone pitch data in the first performance data is a nonharmonic tone pitch with respect to the chord, converting the first performance data into second performance data so that the tone pitch data becomes a harmonic tone pitch; and means for generating third performance data on the basis of the second performance data, wherein performance tones based on the first and third performance data are produced upon execution of the automatic accompaniment.

19. An automatic arrangement apparatus comprising:

melody note input means for inputting melody note data representing a melody note;

chord input means for inputting chord data representing a chord;

detection means for detecting on the basis of the melody note data and the chord data if the melody note is a harmonic note or a nonharmonic note;

reduction note data generation means for, when said detection means detects that the melody note is a harmonic note, determining the melody note data as reduction note data, and for, when said detection means detects that the melody note is a nonharmonic note, converting the melody note into a harmonic note to obtain reduction note data; and additional part generation means for generating an additional part on the basis of the reduction note data generated by said reduction note data generation means.

20. An electronic musical instrument comprising:

melody note input means for inputting melody note data according to a performance of a player;

chord input means for inputting chord data according to the performance of the player;

detection means for detecting on the basis of the melody note data and the chord data if the melody note is a harmonic note or a nonharmonic note;

reduction note data generation means for, when said detection means detects that the melody note is a harmonic note, determining the melody note data as reduction note data, and for, when said detection means detects that the melody note is a nonharmonic note, converting the melody note into a harmonic note to obtain reduction note data;

additional part generation means for generating an additional part on the basis of the reduction note data generated by said reduction note data generation means; and tone generation means for producing tones of the additional part together with performance tones actually played by the player.

* * * * *